US011796173B2

(12) United States Patent
Stockton

(10) Patent No.: US 11,796,173 B2
(45) Date of Patent: Oct. 24, 2023

(54) REACTOR SAFETY DEVICES AND METHODS

(71) Applicant: Hydrogen Technologies LLC, Newtown, PA (US)

(72) Inventor: Edward Joseph Stockton, Stockton, CA (US)

(73) Assignee: Hydrogen Technologies LLC, Newtown, PA (US)

( * ) Notice: Subject to any disclaimer, the term of this patent is extended or adjusted under 35 U.S.C. 154(b) by 0 days.

(21) Appl. No.: 17/839,967

(22) Filed: Jun. 14, 2022

(65) Prior Publication Data

US 2022/0404018 A1 Dec. 22, 2022

Related U.S. Application Data

(60) Provisional application No. 63/211,675, filed on Jun. 17, 2021.

(51) Int. Cl.
*F23N 5/24* (2006.01)
*F23C 99/00* (2006.01)

(52) U.S. Cl.
CPC ..... *F23N 5/242* (2013.01); *F23C 99/00* (2013.01); *F23C 2900/9901* (2013.01); *F23N 2225/04* (2020.01)

(58) Field of Classification Search
CPC ..... F23C 2900/9901; F23N 2225/04; F23N 5/242
USPC ..... 431/124
See application file for complete search history.

(56) References Cited

U.S. PATENT DOCUMENTS 6,258,221 B1 * 7/2001 Lin ..... F23D 14/28 204/266
7,546,732 B2 * 6/2009 Glasgow ..... F23C 99/00 60/677
2007/0037025 A1 2/2007 Venkataraman et al.
2007/0224563 A1 9/2007 Glasgow et al.
(Continued)

FOREIGN PATENT DOCUMENTS

CN 108871651 11/2018
EP 0980106 2/2000
(Continued)

OTHER PUBLICATIONS

PCT International Search Report and Written Opinion for Application No. PCT/US2022/033481 dated Sep. 7, 2022, 12 pages.

*Primary Examiner* — Vivek K Shirsat
(74) *Attorney, Agent, or Firm* — Knobbe, Martens, Olson & Bear, LLP

(57) ABSTRACT

A reactor safety device includes a leg and a well. The leg includes an inlet and an outlet. The inlet is in fluid communication with an outlet of a reactor configured to operate at a pressure less than atmospheric pressure at a location of the reactor safety device. The well includes an inlet in fluid communication with the outlet of the leg. There is a first level in the leg and a second level in the well. The outlet of the leg is vertically lower than the second level. A level sensor is configured to monitor the first level and a controller in communication with the level sensor, a fuel inlet into the reactor, and an oxidant inlet into the reactor. The controller is configured to close the fuel inlet and the oxidant inlet when the first level changes by a predetermined amount.

19 Claims, 3 Drawing Sheets

(56) References Cited

U.S. PATENT DOCUMENTS

| | | | | |
|---|---|---|---|---|
| 2008/0176117 | A1 | 7/2008 | Koike | |
| 2015/0033845 | A1* | 2/2015 | Cacciola ..... | G01F 23/2928 73/293 |

FOREIGN PATENT DOCUMENTS

| | | |
|---|---|---|
| GB | 191228753 | 12/1913 |
| JP | 2016-192269 | 11/2016 |

* cited by examiner

REACTOR SAFETY DEVICES AND METHODS

INCORPORATION BY REFERENCE

The present application claims the benefit of U.S. Provisional Application No. 63/211,675, filed Jun. 17, 2021, titled REACTOR SAFETY DEVICES AND METHODS, the entire contents of which are incorporated by reference herein and made a part of this specification for all purposes.

BACKGROUND

Field

The present disclosure relates generally to safety devices and methods for reactors, and, more particularly, to safety devices and methods for combustion chambers (e.g., for combustion of hydrogen and oxygen).

Description of the Related Art

As the world's population grows and modernizes, the demand for electricity also grows. One option is to build more traditional electric power plants. However, power plants that produce electricity typically also produce high levels of pollution. For example, coal, oil, and natural gas plants burn hydrocarbons to produce energy, but also produce large quantities of greenhouse gases such as carbon monoxide, carbon dioxide, and nitrogen oxides, as well as mercury and sulfur oxides. Additionally, the fuels used in traditional power plants are non-renewable resources that may run out within this century.

An alternative to traditional power plants is nuclear power. Fission reactors generate heat that results from the nuclear fission of uranium, and use that heat to produce steam. The steam is fed into a steam turbine that converts the energy stored in the steam into electricity. While nuclear power plants do not produce greenhouse gases, they do produce nuclear waste, which is toxic and takes millennia to degrade. Furthermore, history has shown that accidents at nuclear plants can have disastrous consequences. As such, nuclear plants are preferably located in isolated areas. However, large urban areas usually do not have the space available for such remote energy sources, and transmission of power typically results in large losses.

Other alternatives to traditional power plants that do not produce greenhouse gases use solar, wind, and wave energy to produce electricity. In addition to still being in the early stages of development, a major drawback to these energy sources is that they lack certainty. For example, when the sun is not shining, the wind is not blowing, or the water is not moving, these sources will not produce electricity. Thus, a need remains for a power source that does not produce greenhouse gases, is not disastrously dangerous, is renewable, and has a high degree of certainty.

SUMMARY

Dynamic combustion chambers for the reaction of pure hydrogen and pure oxygen, for example as disclosed in U.S. Pat. No. 7,546,732, which is hereby incorporated by reference in its entirety for all purposes, can solve many of the challenges presented by traditional power plants. For example, the combustion produces only pure water and heat. The pure water can be recycled to be split into pure hydrogen and oxygen (e.g., using a renewable resource to provide energy for electrolysis) and the heat (e.g., in the form of steam) can be used to directly or indirectly drive turbines to produce electricity. If pure hydrogen and/or pure oxygen are flowing into the reactor without combusting, this could present a serious safety concern. Devices and methods disclosed herein can reduce or eliminate the safety concern associated with a reactor malfunction.

When something goes wrong with a reaction chamber that normally produces a vacuum, the vacuum stops and the reaction chamber rapidly reverts to atmospheric pressure. Depending on the cause of the failure, this can cause an explosion, an implosion, leakage of reactor inputs, leakage of reactor outputs, and damage to the system. Of most concern is the safety of the people operating the system. The systems described herein include a safety system that can shut down the reaction chamber at the first sign of trouble. The vacuum is connected to a leg pipe that acts like a soda straw in that when there is suction, fluid is pulled up the leg. If the suction is constant, then the fluid level reaches a certain height based on the difference between the suction pressure and the atmospheric pressure. Immediately after the vacuum stops, the fluid level drops because there is no longer vacuum pulling it up. That change in fluid level can be detected by a level sensor, and a controller connected to the level sensor and other system components can shut down the system. Shutting down the system may involve setting of an alarm, closing valves, purging with inter gas, and/or other actions. Such quick action can avert catastrophe and even save lives.

In some embodiments, a hydrogen combustion chamber safety device comprises a leg and a well. The leg comprises an inlet and an outlet. The inlet is in fluid communication with an outlet of a hydrogen combustion chamber configured to operate at a pressure less than atmospheric pressure at a location of the hydrogen combustion chamber safety device. The well comprises an inlet in fluid communication with the outlet of the leg. There is a first water level in the leg and a second water level in the well. The outlet of the leg is vertically lower than the second water level. The device comprises a level sensor configured to monitor the first water level in the leg and a controller in communication with the level sensor, a hydrogen inlet into the hydrogen combustion chamber, and an oxygen inlet into the hydrogen combustion chamber. The controller is configured to close the hydrogen inlet and the oxygen inlet when the first water level changes by a predetermined amount.

The predetermined amount may comprise between 0.01 cm and 5 cm. The controller may be configured to emit a signal when the first water level changes by the predetermined amount. The signal may comprise an audible alarm. The signal may comprise a visible alarm. The signal may comprise a wireless signal receivable by a network. The controller may be configured to receive data about atmospheric pressure at the location of the hydrogen combustion chamber safety device. The controller may be configured to adjust the predetermined amount based on a change in the atmospheric pressure at the location of the hydrogen combustion chamber safety device. The device may comprise an eductor. The eductor may be configured to modify the first water level in the leg.

In some embodiments, a reactor safety device comprises a leg and a well. The leg comprises an inlet and an outlet. The inlet is in fluid communication with an outlet of a reactor configured to operate at a pressure less than atmospheric pressure at a location of the reactor safety device. The well comprises an inlet in fluid communication with the outlet of the leg. There is a first level in the leg and a second level in the well. The outlet of the leg is vertically lower than the second level. The device comprises a level sensor configured to monitor the first level in the leg and a controller in communication with the level sensor and one, some, or all inlets into the reactor. The controller is configured to close the inlet(s) when the first level changes by a predetermined amount.

The predetermined amount may comprise between 0.01 cm and 5 cm. The controller may be configured to emit a signal when the first level changes by the predetermined amount. The signal may comprise an audible alarm. The signal may comprise a visible alarm. The signal may comprise a wireless signal receivable by a network. The controller may be configured to receive data about atmospheric pressure at the location of the reactor safety device. The controller may be configured to adjust the predetermined amount based on a change in the atmospheric pressure at the location of the reactor safety device. The device may comprise an eductor. The eductor may be configured to modify the first level in the leg.

In some embodiments, a method of monitoring a reaction chamber comprises monitoring a fluid level in a leg of the reaction chamber and closing a reaction chamber inlet when the fluid level changes by a predetermined amount. The predetermined amount may comprise between 0.01 cm and 5 cm. The method may comprise emitting a signal when the fluid level changes by the predetermined amount. The signal may comprise an audible alarm. The signal may comprise a visible alarm. The signal may comprise a wireless signal receivable by a network. The method may comprise, after closing the reaction chamber inlet, purging the reaction chamber with nitrogen. The method may comprise receiving data about atmospheric pressure at a location of the reaction chamber. The method may comprise adjusting the predetermined amount based on a change in the atmospheric pressure at the location of the reaction chamber. The method may comprise adjusting the fluid level based on a change in the atmospheric pressure at the location of the reaction chamber.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and not to be considered limiting of its scope, the disclosure will be described with additional specificity and detail through use of the accompanying drawings. In the following Detailed Description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the drawings, may be arranged, substituted, combined, and/or designed in a wide variety of different configurations, all of which are explicitly contemplated and made part of this disclosure.

DETAILED DESCRIPTION

Figure 1:
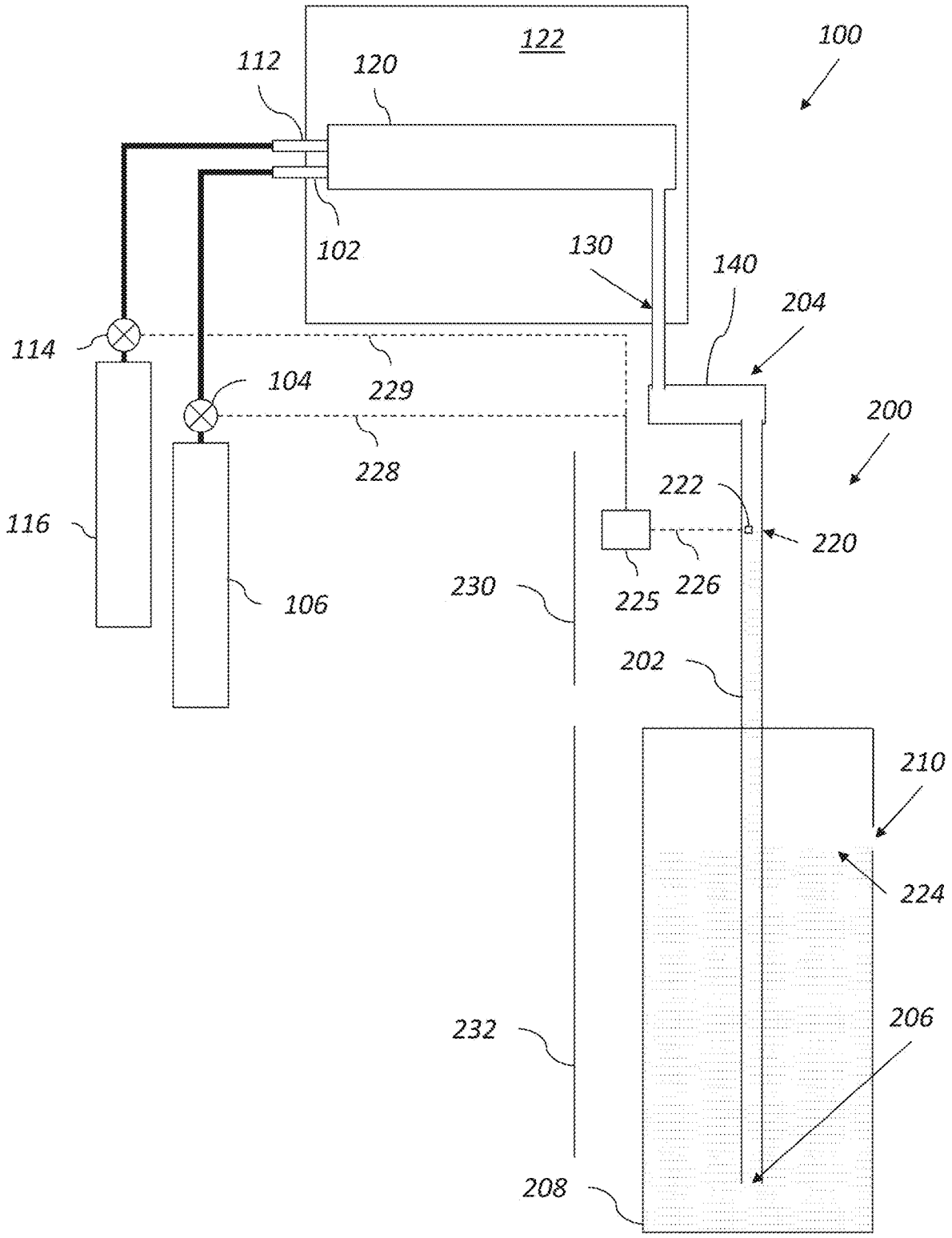
FIG. 1 is a schematic diagram of an example reactor including an example safety device.

FIG. 1 is a schematic representation of a reactor system 100 including a safety system 200. The reactor system 100 comprises a first inlet 102. Preferably, the first inlet 102 is an oxidant inlet. For example, the oxidant may comprise air, oxygen enriched air, pure oxygen, and/or other oxidants. The reactor system 100 comprises a second inlet 112. Preferably, the second inlet 112 is a combustion fuel inlet. For example, the combustion fuel may comprise pure hydrogen, a hydrocarbon, and/or other combustible fuels. The combustion of pure oxygen and pure hydrogen that may be provided by the reactor system 100 can advantageously reduce pollution, for example not producing carbon dioxide, carbon monoxide, or nitrogen oxides due to the absence of carbon and nitrogen during the combustion process. A reaction that produces water as a byproduct is preferred, but not necessary, to the systems described herein. The water discussed herein could be replaced with another fluid that is the byproduct of a reaction.

The first inlet 102 is optionally coupled to a first valve 104. The second inlet 112 is optionally coupled to a second valve 114. The first valve 104 and/or the second valve 114 can allow the reactor system 100 to be coupled to gas sources, including, for example, manifolds or directly to gas supplies (e.g., the first gas source 106 and the second gas source 116 shown in FIG. 1). Other piping and instrumentation to couple the inlets 102, 112 to other appropriate gas sources are also possible. For reactions other than reduction of a combustion fuel, the reactor system 100 could comprise additional inlets. As used herein, the term coupled is a broad term that can include directly coupled or coupled via an intermediate element. The coupling can be permanent or temporary.

The reactor system 100 comprises a reaction chamber 120 in which a reaction between the oxidant and the combustion fuel, or any other set of reactive materials, can take place. The reaction chamber 120 can optionally be inside a second chamber 122 larger than the first chamber. The second chamber 122 can, for example, comprise water that can be evaporated by the heat of the reaction in the reaction chamber 120, and that steam can be used to produce electricity, in a heat exchanger, where steam is needed, etc. In some embodiments, steam from a combustion reaction can be directly used to produce electricity, in a heat exchanger, where steam is needed, etc. The second chamber 122 may comprise a heat transfer material (e.g., hydrocarbons (e.g., a thermal heat transfer fluid from Duratherm of Lewison, N.Y.).

The reaction chamber 120 comprises an outlet 130. Steam from a combustion reaction in the reaction chamber 120 may, for example, be cooled from steam to water (e.g., by heat exchange with fluid in the second chamber 122) that can flow down the outlet 130 via gravity. The condensing steam creates a vacuum inside the reaction chamber 120. In some embodiments, the quantity of water that flows through the outlet is between about 0.5 kilograms/minute (kg/m) and about 2 kg/m (e.g., about 0.5 kg/min, about 0.75 kg/min, about 1 kg/min, about 1.25 kg/min, about 1.5 kg/min, about 2 kg/min, and ranges between such values).

The reaction system 100 optionally comprises a heat transfer device (e.g., condenser, preheater) 140. The heat transfer device 140 can, for example, reduce the temperature of the water coming out of the reaction chamber 120 through the outlet 130, make sure that any steam is condensed, etc. For example, if the water flowing through the outlet is at 212° F. (100° C.), the transfer device 140 can reduce the temperature to 150° F. (approx. 65.6° C.) or any suitable temperature where steam is not likely to exist. The transfer device 140 can comprise a heat exchanger by which the hot water flowing through the transfer device 140 heats another fluid for another process.

The reaction system 100 comprises a safety system 200. The safety system 200 may be called or include a Torricellian column. The safety system 200 could be used for other systems, and is not necessarily limited to the reaction system 100 or a hydrogen combustion chamber. The safety system 200 uses a change in pressure in the reaction chamber 120 as an indicator that an error has occurred so shut down the reaction chamber 120.

The safety system 200 comprises a leg 202. Water from the outlet 130, and optionally through the transfer device 140, flows into the leg 202. The leg 202 is in fluid communication with the chamber 120, which is at vacuum due to the condensation of the water turning gas to liquid and leaving a vacuum. Fluid in the leg 202 has a level 220. The level 220 may be viewed by a user through an optional sight glass 230. The leg 202 is also in fluid communication with a well 208. The well 208 may be closed (e.g., to provide a closed system), but is at atmospheric pressure. The well 208 may comprise an outlet 210. Fluid in the well 208 has a level 224. The level 224 may be viewed by a user through an optional sight glass 232. Fluid in the well 208 may flow out of the outlet 210 when the fluid level 224 is higher than the outlet 210. The fluid may flow to a circulation tank, for example as described herein. The fluid may flow to an electrolysis system (e.g., for the creation of hydrogen and water to use in the reaction chamber 120). The outlet 206 of the leg 202 is vertically lower than the level 224.

The leg 202 may be termed a Torricellian column, in which the same fluid at the same height is at the same pressure such that a difference between the level 220 and the level 224 indicates a difference in pressure in the leg 202 and the well 208. The height difference between the level 220 and the level 224 indicates the difference between the pressure in the chamber 120 and the pressure in the well 208. When the fluid is known, for example being water, the height difference measurement can be easily converted to more well-known units of pressure if desired. For example, for every one centimeter of water height difference between the level 220 and the level 224 (1 cm $H_2O$), the pressure difference is 10 mm $H_2O$, 0.39 in $H_2O$, 98.07 Pascals, 0.074 cm Hg, 0.74 mm Hg, 0.029 in Hg, 0.00097 atm, 0.74 Torr, and 0.014 psi.

If the chamber 120 is at true vacuum (0 cm $H_2O$) and atmospheric pressure is 1,033.23 cm $H_2O$, then the height difference between the level 220 and the level 224 is 1,033.23 cm. Put another way, when the difference between the pressure in the chamber 120 and the atmospheric pressure is: 0 cm $H_2O$−1,033.23 cm $H_2O$=−1,033.23 cm $H_2O$, then the height difference between the level 220 and the level 224 is 1,033.23 cm.

If the chamber 120 is at partial vacuum (e.g., 911.31 cm $H_2O$) and atmospheric pressure is 1,033.23 cm $H_2O$, then the height difference between the level 220 and the level 224 is 121.92 cm. Put another way, when the difference between the pressure in the chamber 120 and the atmospheric pressure is: 911.31 cm $H_2O$−1,033.23 cm $H_2O$=−121.92 cm $H_2O$, then the height difference between the level 220 and the level 224 is 121.92 cm.

If the chamber 120 is at partial vacuum (e.g., 700 cm $H_2O$) and atmospheric pressure is 780.41 cm $H_2O$ (e.g., as can be experienced in Mexico City), then the height difference between the level 220 and the level 224 is 80.41 cm. Put another way, when the difference between the pressure in the chamber 120 and the atmospheric pressure is: 700 cm $H_2O$−780.41 cm $H_2O$=−80.41 cm $H_2O$, then the height difference between the level 220 and the level 224 is 80.41 cm.

The safety system 200 comprises a level sensor 222 configured to sense the level 220 of the fluid in the leg 202. The level sensor 222 is schematically shown in FIG. 1. The level sensor can comprise, for example, a laser sensor, a microwave sensor, an ultrasonic sensor, an optical sensor, a capacitance sensor, and/or a float. Two or more level sensors 222 may be used to confirm that the readings from each are accurate.

The level sensor 222 may be in wired or wireless communication with a controller 225, as shown by the dashed line 226. The controller 225 comprises a memory including executable instructions for determining if the level 222 has changed by a predetermined amount, an alarm limit, or an alarm trigger. The controller 225 can send one or a plurality of signals as an alarm upon sensing that the level 222 has changed by the certain amount. For example, the controller 225 may continuously monitor the level 222. If the level 222 changes by between about 1 cm and about 75 cm (e.g., about 1 cm, about 3 cm, about 5 cm, about 10 cm, about 25 cm, about 50 cm, about 75 cm, and ranges between such values) over a certain amount of time (e.g., between about 0.01 seconds and 1 second (e.g., about 0.01 s, about 0.05 s, about 0.1 s, about 0.15 s, about 0.2 s, about 0.25 s, about 0.5 s, about 0.75 s, about 1 s, and ranges between such values)), then the controller 225 can trigger the alarm.

The alarm can be audible (e.g., audible beeping), visual (e.g., flashing red light), send an electronic signal (e.g., sent to a wired or wireless network, sent to a wireless device, etc.). The controller 225 may be in wired or wireless communication with the first valve 104 and/or the second valve 114, as shown by the dashed lines 228, 229, respectively. The controller 225 may automatically shut off the first valve 104 or the second valve 114, or preferably both the first valve 104 and the second valve 114 upon triggering of the alarm limit. Starving the reactor 120 can inhibit or prevent serious problems that might be caused by whatever issue caused the loss in vacuum pressure. Problems that can cause the level 220 to drop include, for example, flame out, heat exchanger tube failure (e.g., rupture), pipe breach, vessel breach, combinations thereof, and the like. In some embodiments, after shutting off the first valve 104 and the second valve 114, the reactor may be purged with an inert gas (e.g., nitrogen).

Atmospheric pressure at the location of the reaction system 100 may change, for example due to wind, weather, and rotation of the Earth. For example, at sea level, atmospheric pressure may range from about 1,002.42 cm $H_2O$ to about 1,070.48 cm $H_2O$. If the level sensor 222 is set to alarm at too low a range, then a change in atmospheric pressure could trigger the alarm. In some embodiments, the controller 225 is coupled to a barometer configured to measure atmospheric pressure at the site of the reaction system 100. In some embodiments, the controller 225 is coupled to a source of data providing the atmospheric pressure in the vicinity of the reaction system 100. The controller 225 can use the information about the atmospheric pressure to adjust the alarm trigger. For example, if a high pressure atmospheric system moves in and the atmospheric pressure increases from 1,050 cm $H_2O$ to 1,060 cm $H_2O$, then the alarm trigger can be adjusted by 10 cm to account for the change in atmospheric pressure. If the alarm limit is set at 5 cm, for example, that alarm may have been triggered by the change. With the adjustment, the change would have to be 15 cm to trigger the same alarm.

In some embodiments, for example, the reaction system may be a true steam condensing boiler, the fuel being hydrogen. The hydrogen may form in the natural process of combustion "firewater" (e.g., steam generated from the reaction/combustion of hydrogen oxygen). The firewater may condense within the true steam condensing boiler, causing a natural vacuum while draining the water into a safety system, which may be called or include a Torricellian Column. A water column level within the Torricellian Column may rise to a height of the vacuum within the system relative to atmospheric pressure outside of the system, thus giving the system a sliding algorithmic scale in which to operate based on an elevation, location, etc. and/or needs of the user. In the event of a safety issue, examples of which are described herein, including, for example, a "flame-out," the water level within the Torricellian Column will instantaneously drop and a level controller will trip an emergency stop, isolating the oxygen and hydrogen feed system from entering the reaction system.

The Torricellian Column may work in unison with one or multiple other systems, including, for example, burner nozzle differential pressure plates, reaction chamber pressure/temperature parameters, and/or attemperators.

The safety systems described herein, alone or in conjunction with one or other multiple approaches, including, for example, use of an orifice plate nozzle on a burner, designing and processing of one or more reaction boxes, selection of heat capabilities of reactants, transfer of reactants along with an eductor, and/or design/optimization of a heat transfer coefficient of a design of a boiler (e.g., heat exchanger), may allow the absorption of heat from a reaction to be balanced into a process for hot water, steam, and/or to be transferred from one thermodynamic reaction to another without exhaust through a smokestack.

Figure 2:
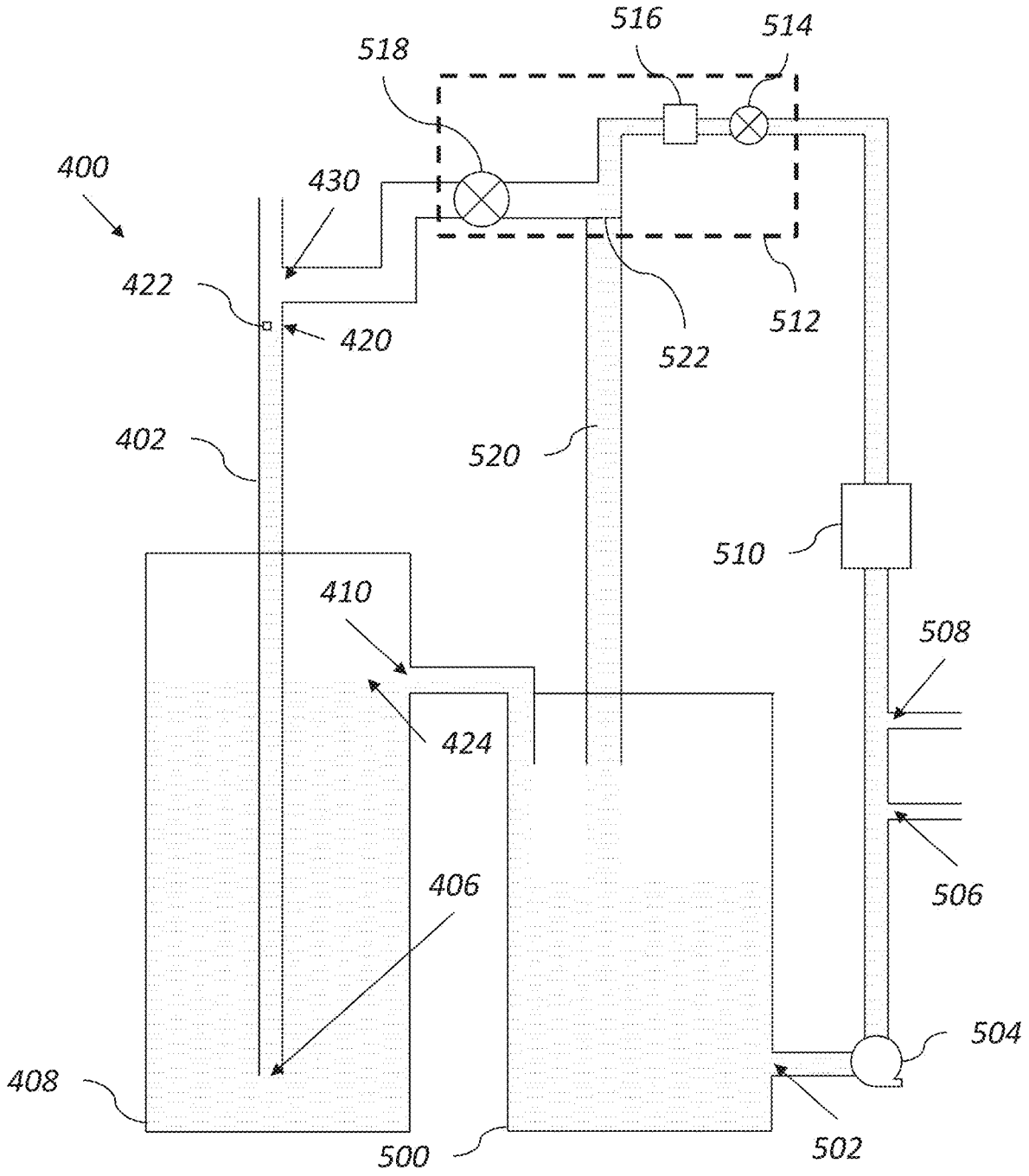
FIG. 2 is a schematic diagram of another example safety device.

FIG. 2 is a schematic diagram of another example safety device 400. The safety device 400 may include one, some, or all of the features of the safety system 200. The safety device 400 can be part of the reactor system 100. Like numbers can indicate like components (e.g., the leg 402, the outlet 406, the well 408, the well outlet 410, the fluid level 420, the level sensor 422, the fluid level 424, etc.). The safety device 400 includes several optional features that could, for example, be added to the safety device 100.

The safety device 400 optionally comprises a circulation tank 500. Fluid from the well outlet 410 can flow into the circulation tank 500, for example, via piping, a berm, etc. The circulation tank 500 comprises an outlet 502 in fluid communication with a pump 504. The pump 504 can draw fluid from the circulation tank. For example, the fluid can be routed to a circulation tank level controller via an optional outlet 506. For another example, the fluid can be routed to a water supply via an optional outlet 508.

The fluid can be passed through an optional heat exchanger 510. The heat exchanger 510 and the transfer device 140 are examples of optional features that may be used to efficiently extract energy from the system 100. The heat exchanger 510 may change (e.g., reduce) the temperature of the fluid prior to entering an optional eductor 512.

The eductor 512 optionally comprises a first valve 514. The eductor 512 optionally comprises a flow meter 516. The eductor 512 optionally comprises a second valve 518. If the first valve 514 is open and the second valve 518 is closed, the fluid may be pumped back into the circulation tank 500 via the down pipe 520. Such circulation may be for the purpose of providing use of the fluid from the circulation tank 500 as described herein. Such circulation may also or alternatively be for the purpose of having the eductor 512 at the ready when desired for affecting the safety device 400.

When the second valve 518 is open, the eductor 512 is in fluid communication with the leg 402 via the second inlet 430. The down pipe 520 and the second inlet 430 have a larger diameter than the remainder of the piping downstream of the pump 504, creating a diverging nozzle after the line 522. The velocity through the down pipe 520 is less than the velocity through the piping between the pump 504 and the line 522. The basic principle of the eductor 512 is that the Bernoulli principle or Venturi effect from the flow of the pumped fluid flowing through the down pipe 520 creates suction at the second inlet 430 because the static pressure increases at the line 522 as the fluid velocity decreases with the change in pipe size. The piping between the second inlet 430 and the line 522 can be considered a suction chamber. The second inlet 430 is in fluid communication with the leg 402, so the operation of the pump 504, the first valve 514, and the second valve 518, for example, can be used to trim the apparent vacuum to a desired level, which can affect the fluid level 420. The eductor 512 may remove undesired gases (e.g., non-compressible gases, CO, $CO_2$, NOx, etc.) from the leg 402.

For example, if the pressure in the reaction chamber 120 is 915 cm $H_2O$ and atmospheric pressure at the location of the reaction chamber 120 and safety device 400 is 1,033.23 cm $H_2O$, then the height of the level 420 over the level 424 is 118.23 cm $H_2O$. The preferred height, for example due to logistics, of level sensor 422, etc. may be 120 cm $H_2O$. The eductor 512 can reduce the pressure via the second inlet 430, for example by 1.77 cm $H_2O$. The apparent vacuum in the leg 402 would appear to be 916.77 cm $H_2O$ such that the height of the level 420 over the level 424 is 120 cm $H_2O$. The eductor 512 can trim the vacuum, acting as a hogger or air ejector.

For another example, if the pressure in the reaction chamber 120 is 920 cm $H_2O$ and atmospheric pressure at the location of the reaction chamber 120 and safety device 400 is 1,033.23 cm $H_2O$, then the height of the level 420 over the level 424 is 113.23 cm. If the atmospheric pressure changes, for example to 1,030 cm $H_2O$, then the height of the level 420 over the level 424 would be 110 cm. This 3.23 cm change (from 113.23 cm to 110 cm) could trigger the alarm system, which would not be desirable if the change was not due to an issue with the reaction chamber. The eductor 512 can be adjusted (e.g., by adjusting the pump 504, by adjusting the first valve 514, and/or by adjusting the second valve 516) based on data about the atmospheric pressure to reduce the pressure experienced by the leg 402 via the second inlet 430, for example by an additional 3.23 cm $H_2O$ such that the height of the level 420 over the level 424 remains 113.23 cm $H_2O$, even with the 3.23 cm $H_2O$ change in atmospheric pressure. There would be no apparent change to the system such that the alarm would not be triggered. In some implementations, a controller can be in communication with the pump 504, the first valve 514, and/or the second valve 518 to implement such changes in additional pressure.

Figure 3:
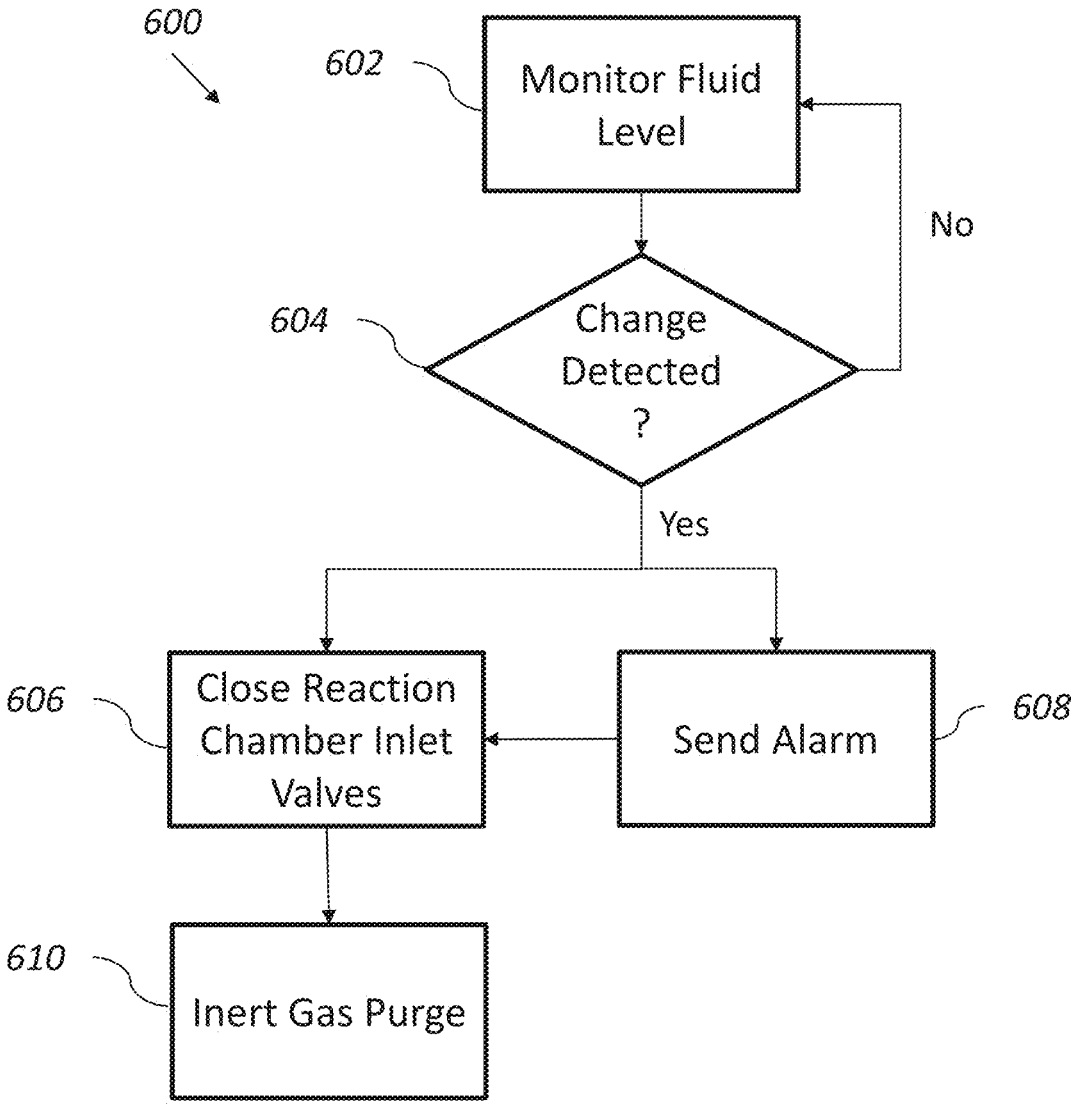
FIG. 3 is an example algorithm for operating a safety device.

FIG. 3 is an example algorithm 600 for operating a safety device. Starting at box 602, the fluid level is monitored. In the next box 604, a change is detected. The change may be a predetermined amount, which may be over a certain amount of time. If a change is not detected, then the fluid level continues to be monitored at box 602. If a change is detected, then one or several things can happen. At box 606, reaction chamber inlet valves may be closed. At box 608, an alarm may be sent. The arrows between the boxes 608 and 606 indicate that the reaction chamber inlet valves may be closed at box 606 after sending the alarm at box 608, for example, because user input is needed to confirm the operation at box 606, because further data may be analyzed (e.g., a second level sensor, atmospheric pressure, other system parameters, etc.). In some implementations, both the boxes 606 and 608 occur substantially simultaneously. In the box 610, an inert gas such as nitrogen may be purged through the reaction chamber 120. The inert gas purge at box 610 should only be performed after the reaction chamber inlet valves are closed at box 606.

The controller 225 may comprise memory. The memory may comprise a non-transitory computer-readable medium. The memory may include one or more memory devices capable of storing data and allowing any storage location to be directly accessed by a microprocessor, such as random access memory (RAM), flash memory (e.g., non-volatile flash memory), and the like. The controller 225 may comprise a storage device, such as one or more hard disk drives or redundant arrays of independent disks (RAID), for storing an operating system and other related software, and for storing application software programs, which may be the memory or a different memory. The instructions in memory for operation of the controller 225 can be set and/or modified based on input, for example, about atmospheric pressure. The instructions in the memory for can be set and/or modified through inputs from a professional via an input. Examples of such an input include a keyboard and/or a mouse (e.g., in conjunction with a display screen), a touch screen, etc. A wide variety of input/output (I/O) devices may be used with the controller 225. Input devices include, for example, keyboards, mice, trackpads, trackballs, microphones, and drawing tablets. Output devices include, for example, video displays, speakers, printers, and wired and wireless signal transmitters. The I/O devices may be controlled by an I/O controller. The I/O controller may control one or more I/O devices. An I/O device may provide storage and/or an installation medium for the controller 225. The controller 225 may provide USB connections to receive handheld USB storage devices. The controller 225 optionally includes a communications port that connects to a peripheral bus, where data and/or programming instructions can be received by the microprocessor and/or the memory.

Input from the input (e.g., from a professional), the communications port, and/or from the an atmospheric pressure unit, for example, can be used to change (e.g., adjust) the parameters of the controller 225 (e.g., the alarm limit(s)). The controller 225 optionally includes a power source. The power source can be a battery or a power source supplied from an external power supply (e.g., an AC/DC power converter coupled to an AC source). The controller 225 optionally includes a housing.

The microprocessor can execute one or more algorithms in order to provide safety upon the loss of vacuum pressure, for example as described herein. The microprocessor can be controlled by a professional via the input to initiate, terminate, and/or change (e.g., adjust) the properties of the controller 225. The microprocessor can execute one or more algorithms to conduct the analysis of the level sensed by the level sensor 222. Such analysis and adjustments can be made using process control logic (e.g., fuzzy logic, negative feedback, etc.) so as to maintain safety of the system.

The controller 225 may comprise one or more additional components, for example a display device, a cache memory (e.g., in communication with the microprocessor), logic circuitry, signal filters, a secondary or backside bus, local buses, local interconnect buses, and the like. The controller 225 may support any suitable installation device, such as a CD-ROM drive, a CD-R/RW drive, a DVD-ROM drive, tape drives of various formats, USB device, hard-drive, communication device to a connect to a server, or any other device suitable for installing software and programs. The controller 225 may include a network interface to interface to a Local Area Network (LAN), Wide Area Network (WAN), or the Internet through a variety of connections including, but not limited to, standard telephone lines, LAN or WAN links, broadband connections, wireless connections (e.g., Bluetooth, WiFi), combinations thereof, and the like. The network interface may comprise a built-in network adapter, network interface card, wireless network adapter, USB network adapter, modem, or any other device suitable for interfacing the controller 225 to any type of network capable of communication and performing the operations described herein. In some examples, the controller 225 may comprise or be connected to multiple display devices, which may be of the same or different in type and/or form. As such, any of the I/O devices and/or the I/O controller may comprise any type and/or form of suitable hardware, software, or combination of hardware and software to support, enable, or provide for the connection and use of multiple display devices by the controller 225. The stimulation system can interface with any workstation, desktop computer, laptop or notebook computer, server, handheld computer, mobile telephone, any other computer, or other form of computing or telecommunications device that is capable of communication and that has sufficient processor power and memory capacity to perform the operations described herein and/or to communication with the controller 225. The lines 226, 228, 229 shown in FIG. 1 generally depict the flow of current and/or information, but current and/or information also flow in any direction depending on the precise implementation.

Analysis, determining, adjusting, and the like described herein may be closed loop control or open loop control. For example, in closed loop control, the controller 225 may analyze fluid level and automatically (e.g., without input from a user) shut of the valves 104, 114. For another example, in open loop control, the controller 225 may analyze fluid level and prompt action by a user to shut off the valves 104, 114 and/or take another action.

Various modifications to the embodiments described in this disclosure will be readily apparent to those skilled in the art, and the generic principles defined herein may be applied to other embodiments without departing from the spirit or scope of this disclosure. Thus, the disclosure is not intended to be limited to the embodiments discussed herein but is to be accorded the widest scope consistent with the claims, the principles and the novel features disclosed herein. The word "example" is used exclusively herein to mean "serving as an example, instance, or illustration." Any embodiment described herein as "example" is not necessarily to be construed as preferred or advantageous over other embodiments, unless otherwise stated.

The foregoing description and examples has been set forth merely to illustrate the disclosure and are not intended as being limiting. Each of the disclosed aspects and examples of the present disclosure may be considered individually or in combination with other aspects, examples, and variations of the disclosure. In addition, unless otherwise specified, none of the steps of the methods of the present disclosure are confined to any particular order of performance. Modifications of the disclosed examples incorporating the spirit and substance of the disclosure may occur to persons skilled in the art and such modifications are within the scope of the present disclosure. Furthermore, all references cited herein are incorporated by reference in their entirety.

Certain features that are described in this specification in the context of separate embodiments also may be embodied in combination in a single embodiment. Conversely, various features that are described in the context of a single embodiment also may be embodied in multiple embodiments separately or in any suitable sub-combination. Moreover, although features may be described above as acting in certain combinations and even initially claimed as such, one or more features from a claimed combination may in some cases be excised from the combination, and the claimed combination may be directed to a sub-combination or variation of a sub-combination.

Similarly, while operations are depicted in the drawings in a particular order, this should not be understood as requiring that such operations be performed in the order shown or in sequential order, or that all illustrated operations be performed, to achieve desirable results. Additionally, other embodiments are within the scope of the following claims. In some cases, the actions recited in the claims may be performed in a different order and still achieve desirable results.

While the methods and devices described herein may be susceptible to various modifications and alternative forms, specific examples thereof have been shown in the drawings and are herein described in detail. It should be understood, however, that the invention is not to be limited to the particular forms or methods disclosed, but, to the contrary, the invention is to cover all modifications, equivalents, and alternatives falling within the spirit and scope of the various examples described and the appended claims. Further, the disclosure herein of any particular feature, aspect, method, property, characteristic, quality, attribute, element, or the like in connection with an example can be used in all other examples set forth herein. Any methods disclosed herein need not be performed in the order recited. Depending on the example, one or more acts, events, or functions of any of the algorithms, methods, or processes described herein can be performed in a different sequence, can be added, merged, or left out altogether (e.g., not all described acts or events are necessary for the practice of the algorithm). In some examples, acts or events can be performed concurrently, e.g., through multi-threaded processing, interrupt processing, or multiple processors or processor cores or on other parallel architectures, rather than sequentially. Further, no element, feature, block, or step, or group of elements, features, blocks, or steps, are necessary or indispensable to each example. Additionally, all possible combinations, subcombinations, and rearrangements of systems, methods, features, elements, modules, blocks, and so forth are within the scope of this disclosure. The use of sequential, or time-ordered language, such as "then," "next," "after," "subsequently," and the like, unless specifically stated otherwise, or otherwise understood within the context as used, is generally intended to facilitate the flow of the text and is not intended to limit the sequence of operations performed. Thus, some examples may be performed using the sequence of operations described herein, while other examples may be performed following a different sequence of operations.

The various illustrative logical blocks, modules, processes, methods, and algorithms described in connection with the examples disclosed herein can be implemented as electronic hardware, computer software, or combinations of both. To clearly illustrate this interchangeability of hardware and software, various illustrative components, blocks, modules, operations, and steps have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of the disclosure.

The various illustrative logical blocks and modules described in connection with the examples disclosed herein can be implemented or performed by a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor can be a microprocessor, but in the alternative, the processor can be a controller, microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

The blocks, operations, or steps of a method, process, or algorithm described in connection with the examples disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, an optical disc (e.g., CD-ROM or DVD), or any other form of volatile or non-volatile computer-readable storage medium known in the art. A storage medium can be coupled to the processor such that the processor can read information from, and write information to, the storage medium. In the alternative, the storage medium can be integral to the processor. The processor and the storage medium can reside in an ASIC. The ASIC can reside in a user terminal. In the alternative, the processor and the storage medium can reside as discrete components in a user terminal.

Conditional language used herein, such as, among others, "can," "might," "may," "e.g.," and the like, unless specifically stated otherwise, or otherwise understood within the context as used, is generally intended to convey that some examples include, while other examples do not include, certain features, elements, and/or states. Thus, such conditional language is not generally intended to imply that features, elements, blocks, and/or states are in any way required for one or more examples or that one or more examples necessarily include logic for deciding, with or without author input or prompting, whether these features, elements and/or states are included or are to be performed in any particular example.

The methods disclosed herein may include certain actions; however, the methods can also include any third-party instruction of those actions, either expressly or by implication. For example, actions such as "monitoring a fluid level" include "instructing monitoring a fluid level."

The ranges disclosed herein also encompass any and all overlap, sub-ranges, and combinations thereof. Language such as "up to," "at least," "greater than," "less than,"

"between," and the like includes the number recited. Numbers preceded by a term such as "about" or "approximately" include the recited numbers and should be interpreted based on the circumstances (e.g., as accurate as reasonably possible under the circumstances, for example ±5%, ±10%, ±15%, etc.). For example, "about 2 kg/m" includes "2 kg/m." Phrases preceded by a term such as "substantially" include the recited phrase and should be interpreted based on the circumstances (e.g., as much as reasonably possible under the circumstances). For example, "substantially perpendicular" includes "perpendicular." Unless stated otherwise, all measurements are at standard conditions including temperature and pressure. The phrase "at least one of" is intended to require at least one item from the subsequent listing, not one type of each item from each item in the subsequent listing. For example, "at least one of A, B, and C" can include A, B, C, A and B, A and C, B and C, or A, B, and C.

What is claimed is:

1. A hydrogen combustion chamber safety device comprising:

a leg comprising an inlet and an outlet, the inlet in fluid communication with an outlet of a hydrogen combustion chamber, the hydrogen combustion chamber configured to operate at a pressure less than an atmospheric pressure occurring at a location of the hydrogen combustion chamber safety device;

a well comprising an inlet in fluid communication with the outlet of the leg;

a first water level in the leg;

a second water level in the well, the outlet of the leg being vertically lower than the second water level;

a level sensor configured to monitor the first water level in the leg; and a controller in communication with the level sensor, a hydrogen inlet into the hydrogen combustion chamber, and an oxygen inlet into the hydrogen combustion chamber, wherein the controller is configured to close the hydrogen inlet and the oxygen inlet when the first water level changes by a predetermined amount.

2. The device of claim 1, wherein the predetermined amount comprises between 0.01 cm and 5 cm.

3. The device of claim 1, wherein the controller is configured to emit a signal when the first water level changes by the predetermined amount.

4. The device of claim 1, wherein the controller is configured to receive data about atmospheric pressure at the location of the hydrogen combustion chamber safety device.

5. The device of claim 1, further comprising an eductor configured to modify the first water level in the leg.

6. A reactor safety device comprising:

A leg comprising an inlet and an outlet, the inlet in fluid communication with an outlet of a reactor, the reactor configured to operate at a pressure less than an atmospheric pressure occurring at a location of the reactor safety device;

a well comprising an inlet in fluid communication with the outlet of the leg;

a first fluid level in the leg;

a second fluid level in the well, the outlet of the leg being vertically lower than the second fluid level;

a level sensor configured to monitor the first fluid level in the leg; and a controller in communication with the level sensor and at least one inlet into the reactor, wherein the controller is configured to close the at least one inlet when the first fluid level changes by a predetermined amount.

7. The device of claim 6, wherein the fluid comprises water.

8. The device of claim 6, wherein the predetermined amount comprises between 0.01 cm and 5 cm.

9. The device of claim 6, wherein the controller is configured to emit a signal when the first fluid level changes by the predetermined amount.

10. The device of claim 9, wherein the signal comprises an audible alarm.

11. The device of claim 9, wherein the signal comprises a visible alarm.

12. The device of claim 9, wherein the signal comprises a wireless signal receivable by a network.

13. The device of claim 6, wherein the controller is configured to receive data about atmospheric pressure at the location of the reactor safety device and to adjust the predetermined amount based on a change in the atmospheric pressure at the location of the reactor safety device.

14. The device of claim 6, further comprising an eductor configured to modify the first fluid level in the leg.

15. The device of claim 3, wherein the signal comprises an audible alarm.

16. The device of claim 3, wherein the signal comprises a visible alarm.

17. The device of claim 3, wherein the signal comprises a wireless signal receivable by a network.

18. The device of claim 4, wherein the controller is configured to adjust the predetermined amount based on a change in the atmospheric pressure at the location of the reactor safety device.

19. The device of claim 6, wherein the controller is configured to receive data about atmospheric pressure at the location of the reactor safety device and to adjust the first fluid level based on a change in the atmospheric pressure at the location of the reactor safety device.

* * * * *